US009677862B2

(12) United States Patent
Hendrixson et al.

(10) Patent No.: US 9,677,862 B2
(45) Date of Patent: Jun. 13, 2017

(54) MUTLI-STAGE FRAGMENTING PROJECTILE

(71) Applicant: Maker Holdings, LLC, Cumming, GA (US)

(72) Inventors: Paul Harvey Hendrixson, Cumming, GA (US); Constant Johannes Laubscher, Cumming, GA (US)

(73) Assignee: Maker Holdings, LLC, Cummings, GA (US)

( * ) Notice: Subject to any disclaimer, the term of this patent is extended or adjusted under 35 U.S.C. 154(b) by 46 days.

(21) Appl. No.: 14/689,120

(22) Filed: Apr. 17, 2015

(65) Prior Publication Data

US 2016/0282095 A1 Sep. 29, 2016

Related U.S. Application Data

(60) Provisional application No. 61/980,968, filed on Apr. 17, 2014.

(51) Int. Cl.
*F42B 12/22* (2006.01)
*F42B 12/34* (2006.01)

(52) U.S. Cl.
CPC ..... *F42B 12/34* (2013.01)

(58) Field of Classification Search
CPC ..... F42B 12/34
USPC ..... 102/506
See application file for complete search history.

(56) References Cited

U.S. PATENT DOCUMENTS 2,045,964 A * 6/1936 Rinkel ..... F42B 12/34 102/509
2,333,091 A * 11/1943 Crasnoff ..... F42B 12/34 102/507
3,003,420 A * 10/1961 Nosler ..... F42B 12/34 102/508
3,665,861 A * 5/1972 Jaslow ..... F42B 5/03 102/506
4,776,279 A * 10/1988 Pejsa ..... F42B 12/34 102/510
5,149,913 A * 9/1992 Arakaki ..... F42B 12/34 102/506
6,484,642 B1 * 11/2002 Kuhns ..... F42B 12/24 102/493
7,299,750 B2 * 11/2007 Schikora ..... F42B 12/34 102/506
9,354,027 B2 * 5/2016 Flint ..... F42B 12/367
2005/0241523 A1 * 11/2005 Schikora ..... F42B 12/34 102/510
2012/0090492 A1 * 4/2012 Rebar ..... F42B 12/34 102/510
2012/0266773 A1 * 10/2012 Eckstein ..... F42B 5/03 102/506
2015/0330751 A1 * 11/2015 Flint ..... F42B 12/367 102/507

* cited by examiner

*Primary Examiner* — Samir Abdosh
(74) *Attorney, Agent, or Firm* — Michael L. Leetzow, P.A.

(57) ABSTRACT

A multi-stage fragmenting projectile has a number of grooves and slots that are strategically placed on and around the periphery of the projectile. After the projectile engages an object, a first set of fragments separates from a main body of the projectile. A second set of fragments separate a short time later after the projectile has traveled farther in the object.

19 Claims, 9 Drawing Sheets

MUTLI-STAGE FRAGMENTING PROJECTILE

REFERENCE TO RELATED CASE

This application claims priority under 35 U.S.C. §119(e) to provisional application No. 61/980,968, filed on Apr. 17, 2014, which is hereby incorporated by reference in its entirety.

FIELD OF THE INVENTION

Projectiles typically are of relatively small diameter and thus create a small opening in an object into which they are projected or fired. While the diameter of the projectile may be increased and openings in the nose of the projectile allow for the projectile to create a larger opening and a larger void in the object, respectively, the openings are still sometimes insufficient for the purposes needed. Other projectiles have been manufactured to allow for some fragmentation, but that fragmentation occurs only once and typically right after entry. Multiple stages of fragmentation would provide for a larger void within the object.

Thus, a new fragmenting projectile has multi-stage fragmentation, providing a first stage of fragmentation of the projectile or bullet followed shortly thereafter with a second stage of fragmentation.

SUMMARY OF THE INVENTION

The present invention is directed to a fragmenting projectile that includes a main body having a front end, a back end, and a middle portion therebetween, the main body having a longitudinal axis extending therealong, an opening extending from the front end toward the middle portion, the opening having a bottom, at least two circumferential grooves extending around the main body, a first circumferential groove disposed between the front end and a second circumferential groove, the second circumferential groove being disposed between the first groove and the bottom of the opening, a first plurality of slots disposed around the main body and extending from the front end rearwardly towards the back end and the first circumferential groove, and a second plurality of slots disposed around the main body, the second plurality extending between the first and second circumferential groves.

In some embodiments, one of the first plurality of slots is at least partially disposed between two of the second plurality of slots.

In other embodiments, the first and second plurality of slots extend at least partially around the main body.

In yet other embodiments, the first and second plurality of slots have a constant depth.

The present invention is also directed to a fragmenting projectile that includes a main body having a front end, a back end, and a middle portion therebetween, the main body having a longitudinal axis extending therealong, an opening extending from the front end toward the middle portion, the opening having a bottom, a first means for fragmenting at least a portion of the projectile in a first stage after engaging an object, and a second means for fragmenting at least a portion of the projectile in a second stage after engaging the object, the second stage coming after the first stage.

In some embodiments, the first means comprises a first circumferential groove and a first plurality of slots extending from the front end of the main body to the first circumferential groove and the second means comprises a second circumferential groove disposed between the first circumferential groove and the back end and a second plurality of slots extending from the first circumferential groove to the second circumferential groove.

Additional features and advantages of the invention will be set forth in the detailed description which follows and, in part, will be readily apparent to those skilled in the art from that description or recognized by practicing the invention as described herein, including the detailed description, the claims, and the appended drawings.

It is to be understood that both the foregoing general description and the following detailed description of the present embodiments of the invention are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and, together with the description, serve to explain the principles and operations of the invention.

DETAILED DESCRIPTION OF THE PREFERRED EMBODIMENTS

Figure 1:
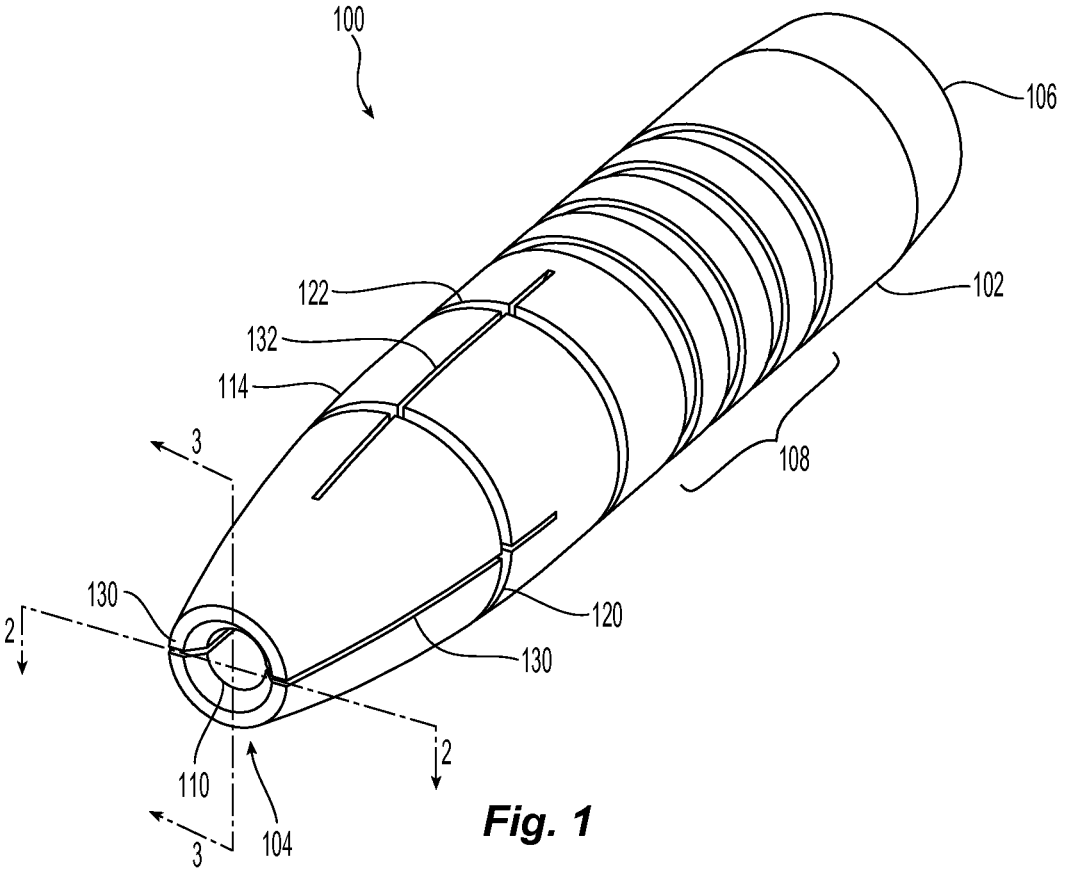
FIG. 1 is a perspective view of one embodiment of a fragmenting projectile according to the present invention.
Figure 2:
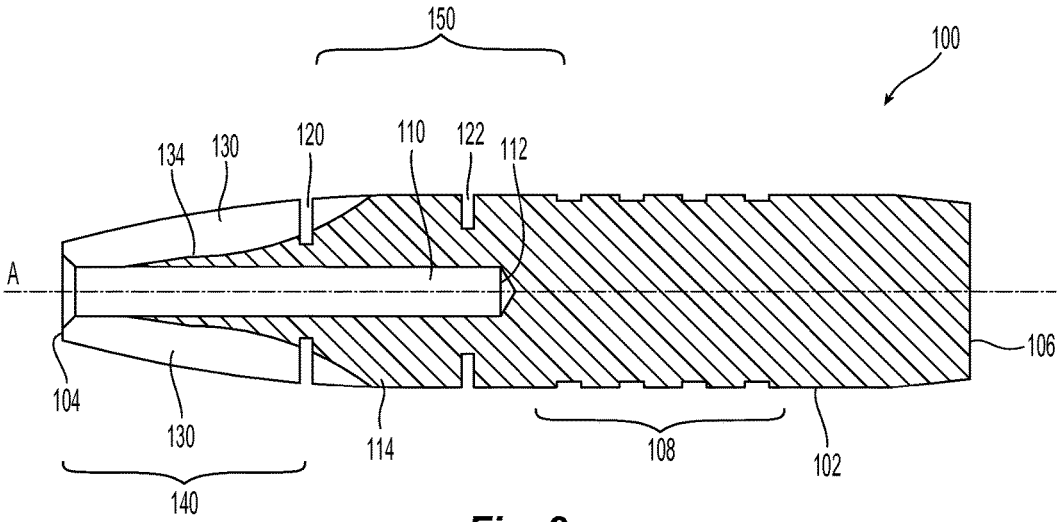
FIG. 2 is a cross section view of the fragmenting projectile in FIG. 1 along the line 2-2.
Figure 3:
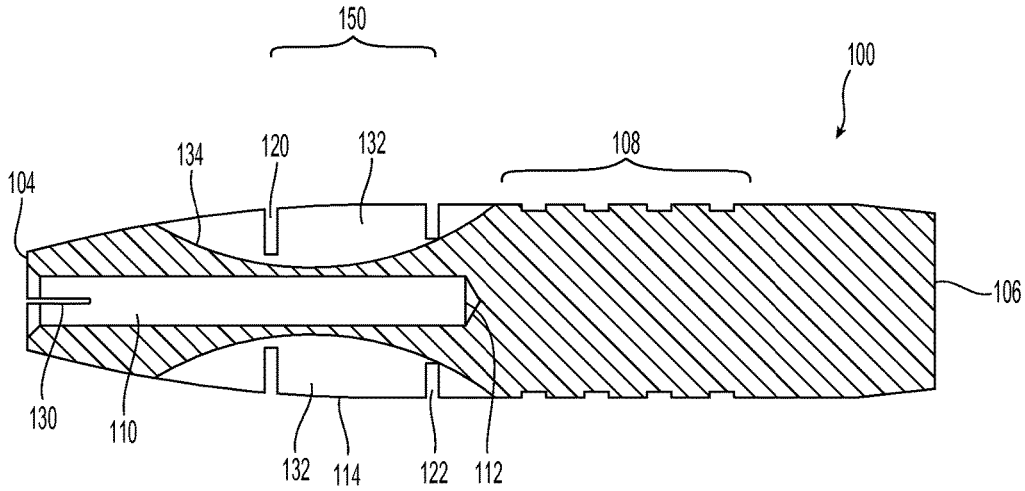
FIG. 3 is cross section view of the fragmenting projectile in FIG. 1 along the line 3-3.
Figure 4:
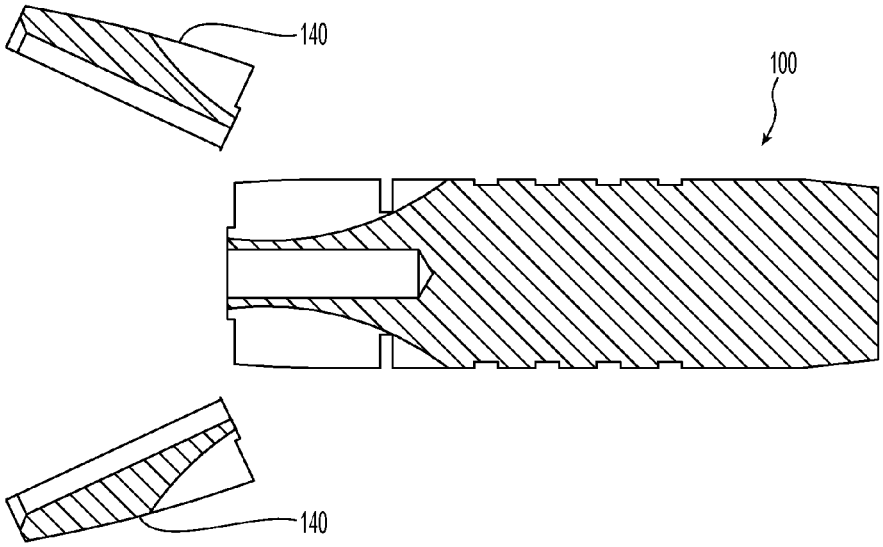
FIG. 4 is a perspective view of a cross section of the fragmenting projectile of FIG. 3 schematically illustrating the first stage of fragmentation.
Figure 5:
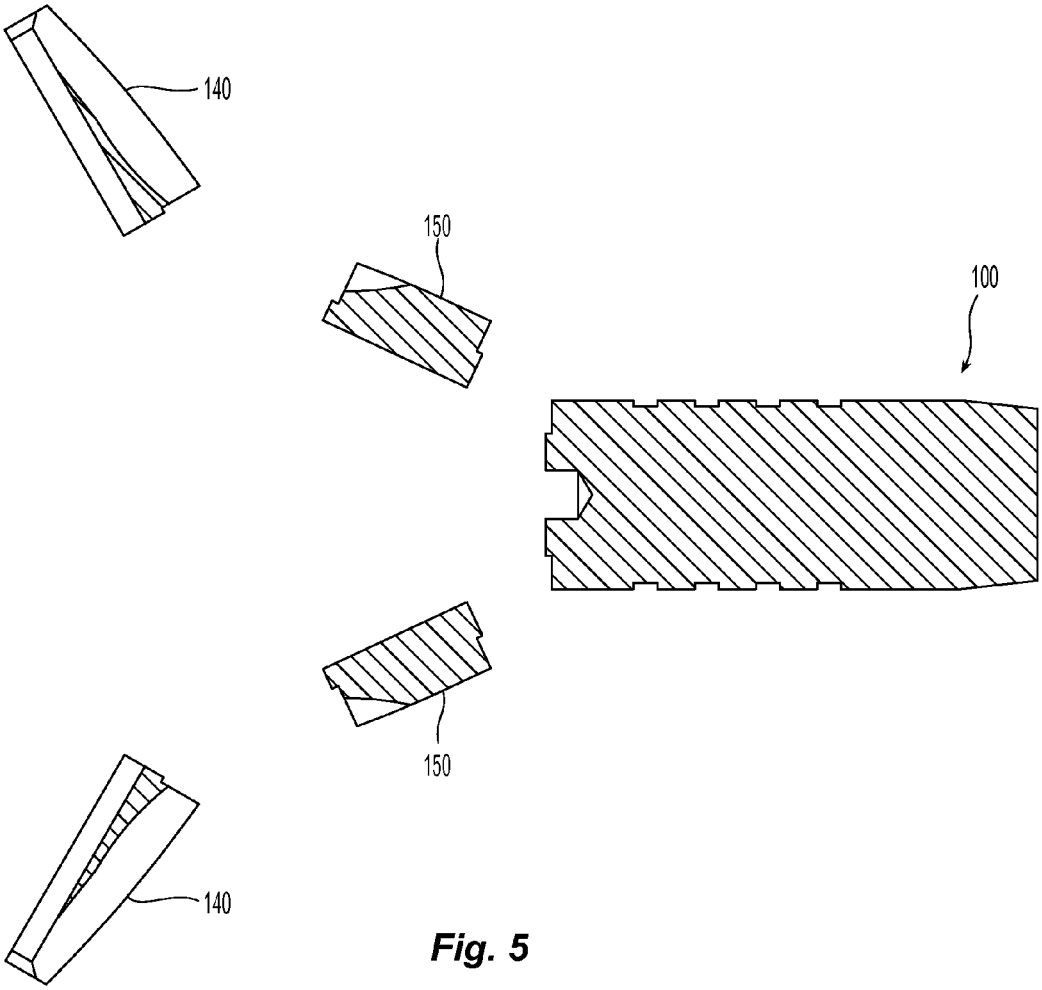
FIG. 5 is a perspective view of a cross section of the fragmenting projectile of FIG. 2 schematically illustrating the second stage of fragmentation.

Reference will now be made in detail to the present preferred embodiment(s) of the invention, examples of which are illustrated in the accompanying drawings. Whenever possible, the same reference numerals will be used throughout the drawings to refer to the same or like parts.

One embodiment of a fragmenting projectile 100 is illustrated in FIGS. 1-5. The fragmenting projectile 100 has a main body 102 having a front end 104, a back end 106, and a middle portion 108 therebetween. The main body 102 has a longitudinal axis A extending therealong. See FIG. 2. The main body 102 also has an opening 110 extending from the front end 104 toward the middle portion 108, the opening 110 having a bottom 112. See FIGS. 2-5. The main body 102 is preferably made of a dense material such as copper, lead or other alloy, but any appropriate material may be used and still fall within the scope of the present invention. Additionally, given the number of different combinations of diameters of the fragmenting projectile 100 and the differences in weights, it should realized that the specific shape of the projectile 100 may be changed and fall within the scope of the present invention as well.

The main body 102 also includes at least two circumferential grooves extending around the main body 102. A first circumferential groove 120 is disposed between the front end 104 and a second circumferential groove 122. The first and second circumferential grooves 120,122 extend from an outer surface 114 of the main body 102 toward the opening 100, which has an axis that coincides with the longitudinal axis A of the main body 102. The second circumferential groove 122 being disposed between the first groove and the back end 106 of the main body 102. The second circumferential groove 122 may also be more preferably disposed between the first circumferential groove 120 and the bottom 112 of the opening 110.

The main body 102 also includes a first plurality of slots 130 disposed around the main body 102 and extending from the front end 104 rearwardly towards the back end 106 and the first circumferential groove 120. As illustrated in FIGS. 1-5, there are two slots 130 in the first plurality of slots in the first embodiment of the fragmenting projectile 100. See in particular FIG. 2. As described in more detail below, there can be additional slots in the plurality of slots, e.g., three or four in each of the plurality of slots. See FIGS. 6 & 8. There is also a second plurality of slots 132 disposed around the main body 102, the second plurality of slots 132 extending between the first and second circumferential groves 120,122. See in particular FIG. 3. As illustrated in FIG. 1, the first plurality of slots 130 extend between the front end 104 and at least the first circumferential groove 120, and the second plurality of slots 132 extend between at least the first and second circumferential grooves 120,122. The reason for these positionings will become more clear in the discussion related to FIGS. 4 and 5 below.

As the fragmenting projectile 100 enters an object (not illustrated for clarity), the opening 110 in combination with the first plurality of slots 130 and the first circumferential groove 120 allow the front portion 140 of the fragmenting projectile 100 to be detached from the main body 102 after interacting with the object in two pieces. See FIG. 4. As the fragmenting projectile 100 travels farther into the object, and with the front portion 140 of the fragmenting projectile 100 now detached, the second portion 150 of the fragmenting projectile 100 engage the object and two more pieces detach as well. See FIG. 5.

As illustrated, the first and second plurality of slots 130, 132 have a generally circular shape, with the bottom surface 134 of the slots being curved relative to the longitudinal axis A. Also, given the shape of the outer surface 114 of the main body 102, and the need to have at least a portion of the main body disposed between the first and second plurality of slots 130, 132 and the opening 110, the first and second plurality of slots 130, 132 have a variable depth. However, the first and second plurality of slots 130, 132 may also be made so that the depth thereof is constant. See, e.g, slots 532 in FIG. 11.

Figure 6:
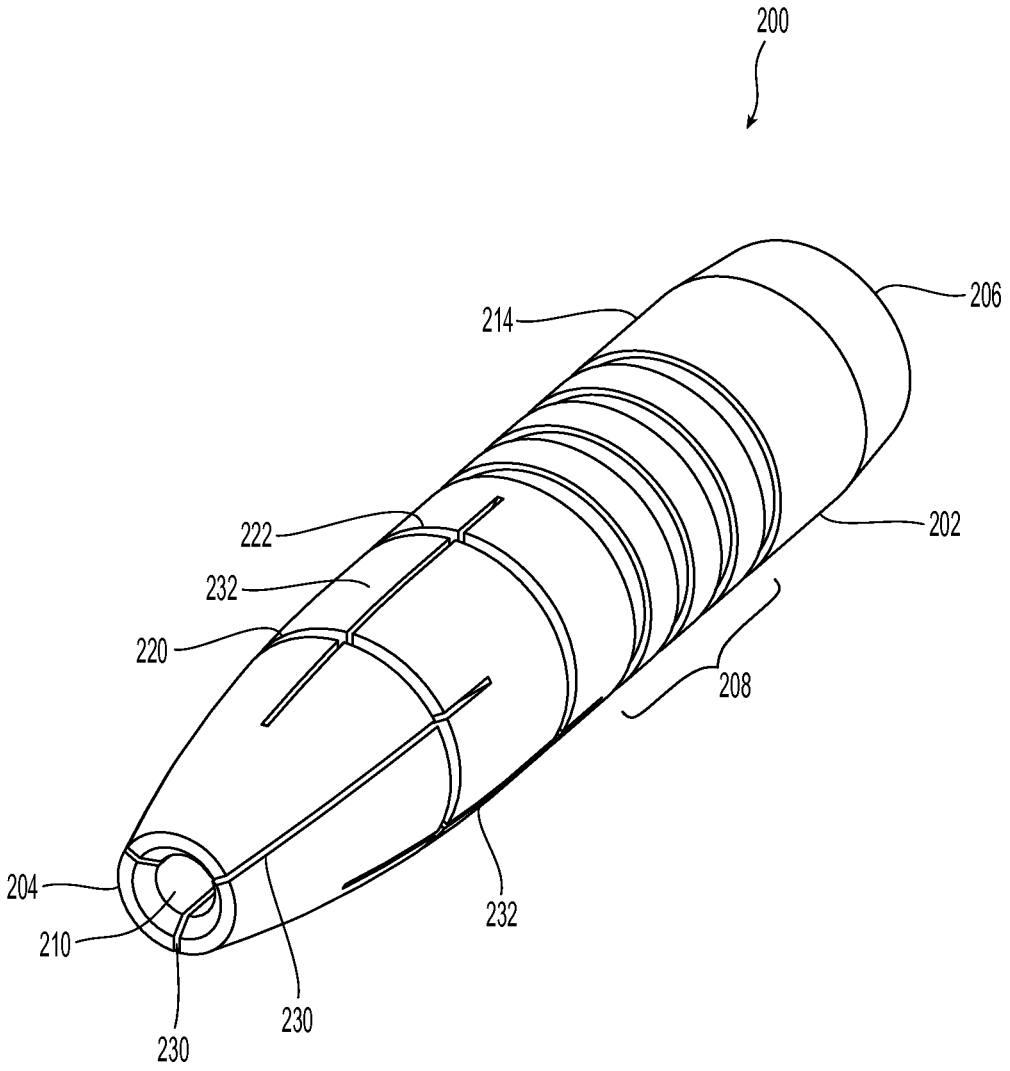
FIG. 6 is a perspective view of a second embodiment of a fragmenting projectile according to the present invention.
Figure 7:
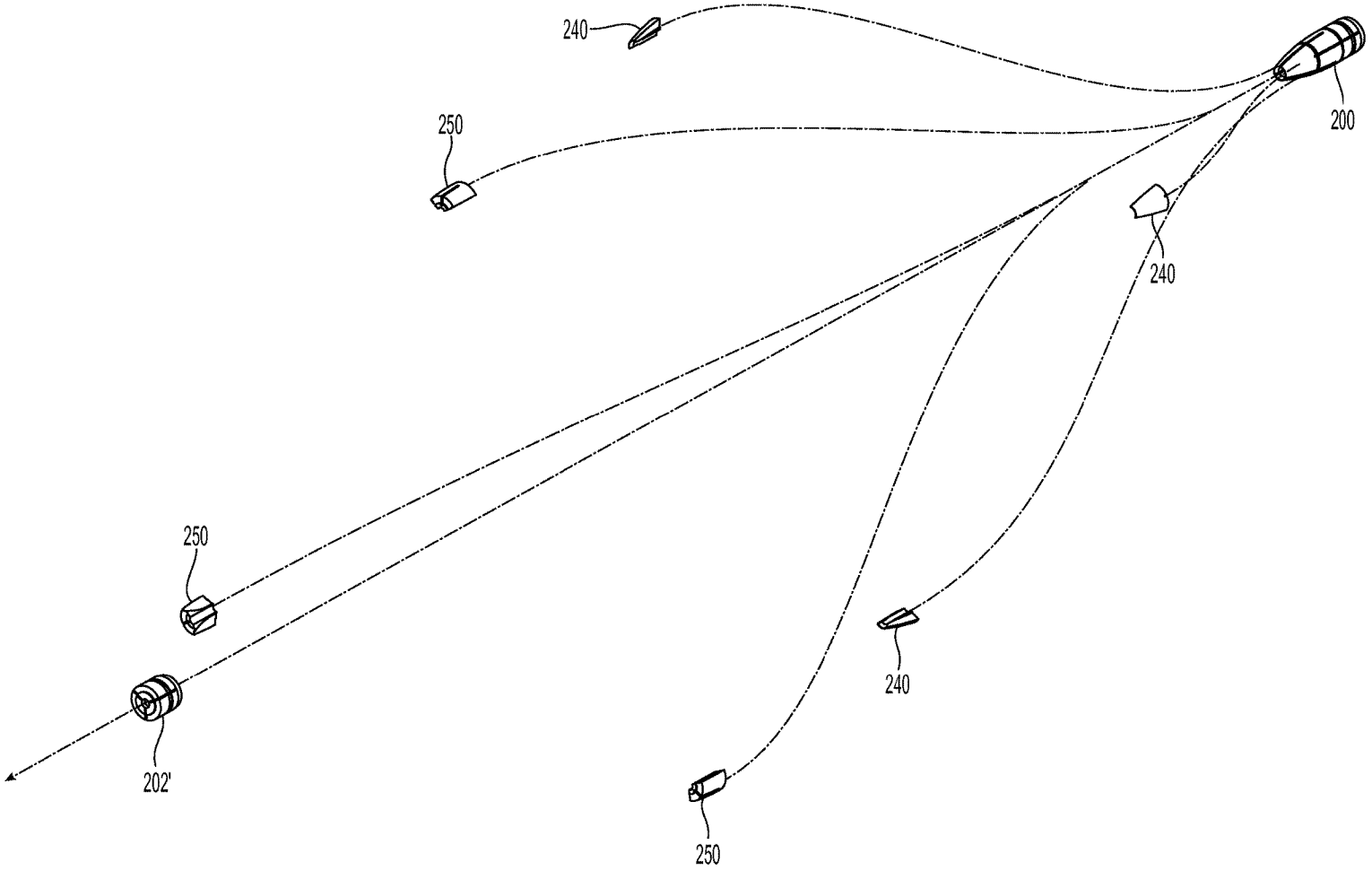
FIG. 7 is a perspective view of the fragmenting projectile in FIG. 6 schematically showing the fragmentation of the projectile as it travels through an object, the object being removed to show approximate paths of the fragments.

Another embodiment of a fragmenting projectile 200 is illustrated in FIGS. 6 and 7. Fragmenting projectile 200 has a main body 202 having a front end 204, a back end 206, and a middle portion 208 therebetween. The main body 202 also has an opening 210 extending from the front end 204 toward the middle portion 208, the opening 210 also having a bottom (not shown).

The main body 202 also includes two circumferential grooves extending around the main body 202. A first circumferential groove 220 is disposed between the front end 204 and a second circumferential groove 222. The first and second circumferential grooves 220,222 extend from an outer surface 214 of the main body 202 toward the opening 200. The second circumferential groove 222 being disposed between the first groove and the back end 206 of the main body 202. The second circumferential groove 222 may also be more preferably disposed between the first circumferential groove 220 and the bottom 212 of the opening 210.

The main body 202 also includes a first plurality of slots 230 disposed around the main body 202 and extending from the front end 204 rearwardly towards the back end 206 and the first circumferential groove 220. As illustrated in FIG. 6, there are now three slots 230 in the first plurality of slots in the first embodiment of the fragmenting projectile 200. There is also a second plurality of slots 232 disposed around the main body 202, the second plurality of slots 232 extending between the first and second circumferential groves 220,222. There are three slots in the second plurality of slots 232.

FIG. 7 illustrates in a three dimensional representation how the first and the second portions detach after entering the object (not shown). The front portion 240 of the fragmenting projectile 200 detaches first (three pieces in the first portion with the three slots 230), and then the second portion 250 of the fragmenting projectile 200 engages the object and three more pieces detach as well, leaving only a portion of the main body 202'.

Figure 8:
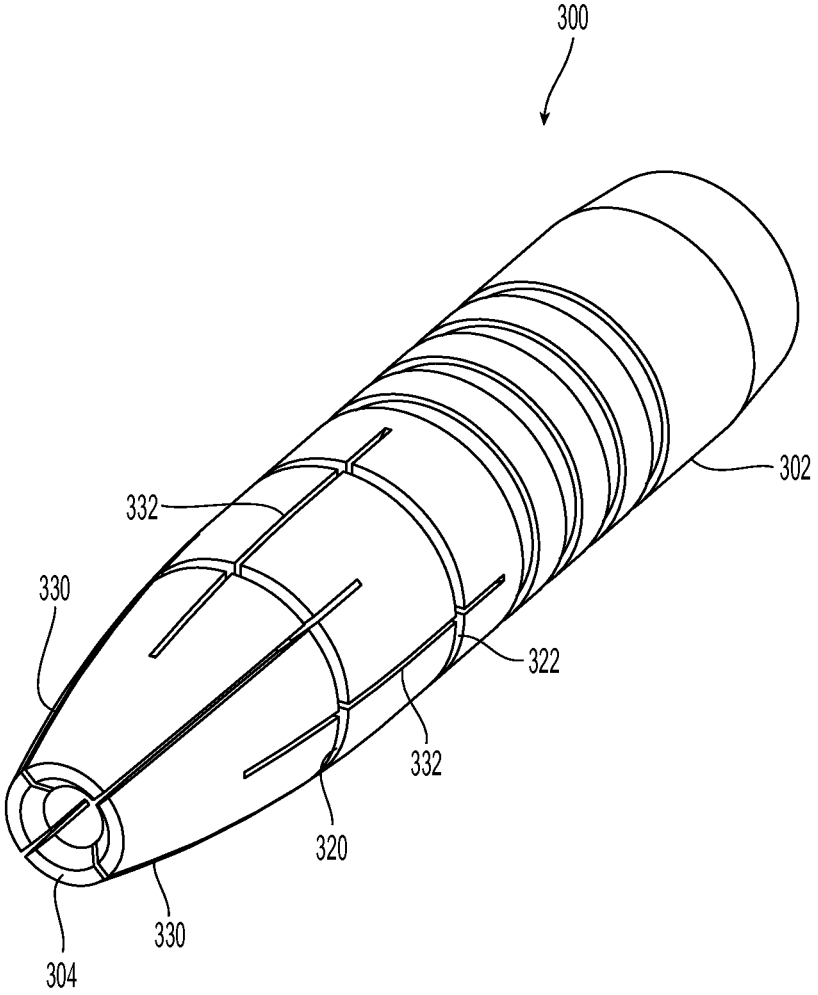
FIG. 8 is a perspective view of a third embodiment of a fragmenting projectile according to the present invention

Another fragmenting projectile 300 is illustrated in FIG. 8. In this embodiment, the fragmenting projectile 300 has the same number of circumferential grooves extending around the main body 302. A first circumferential groove 320 is disposed behind the front end 304 and also has a more rearward second circumferential groove 322. The circumferential grooves 320, 322 determine the number of stages of fragmentation. The fragmenting projectile 300 also has a first and second plurality of slots 330,332, which number four in this embodiment. As can be recognized, it is preferable that the plurality of slots in the embodiments are equally distributed around the periphery of the projectiles. However, provided that the projectiles could be otherwised balanced for rotation, the plurality of slots could be spaced in other ways. Fragmentation of the fragmenting projectile 300 leads to four pieces in the first and second stages, referring to FIG. 7

Figure 9:
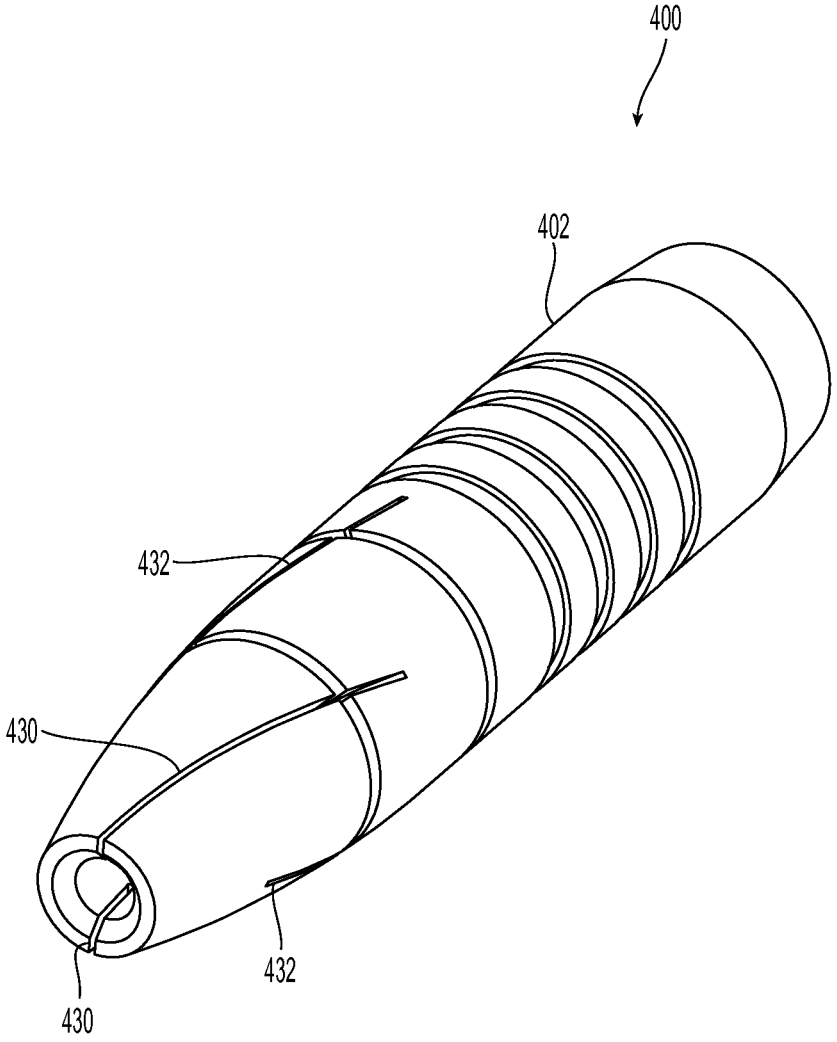
FIG. 9 is a perspective view of a fourth embodiment of a fragmenting projectile according to the present invention.

Another fragmenting projectile 400 is illustrated in FIG. 9. The main body 402 of the fragmenting projectile 400 may be the same as those described above. However, in this embodiment, the first and second plurality of slots 430,432 extend at least partially around the main body 402. Thus, the first and second plurality of slots 430,432 are more helical, rather than the linear slots noted above. While only two slots are illustrated in each of the plurality of slots 430,432, there could be three, four or even more and still fall within the scope of the present invention.

Figure 10:
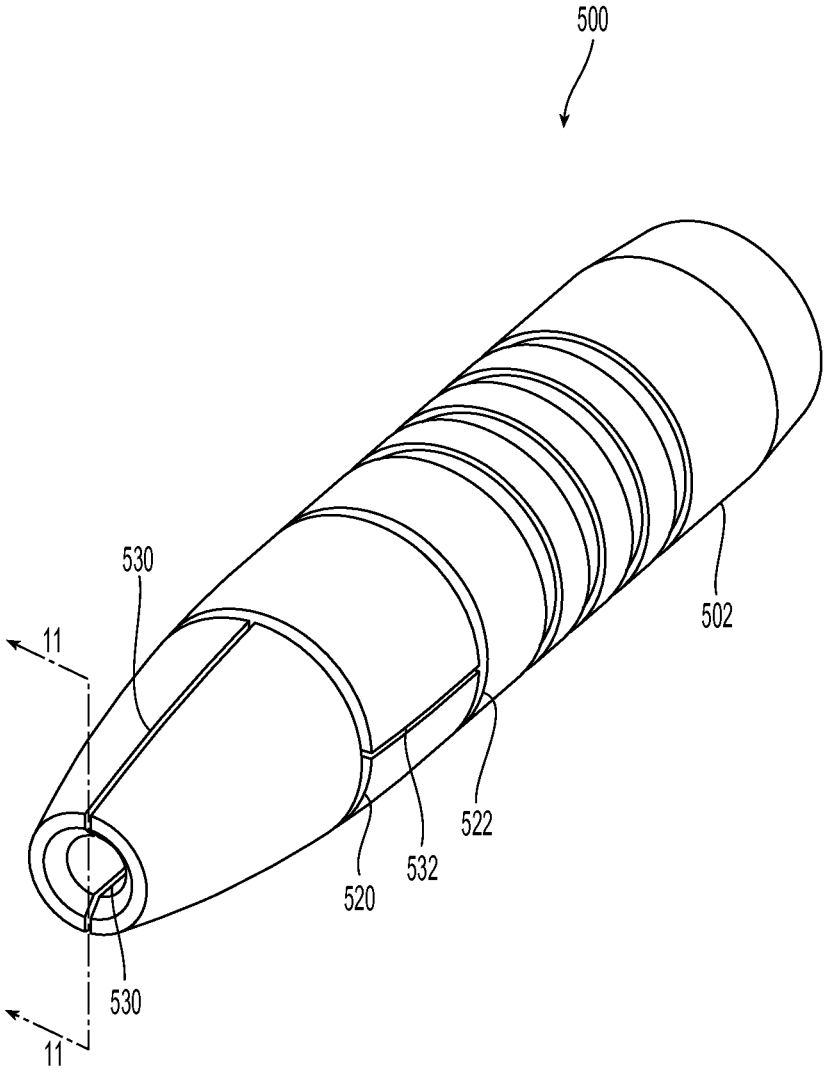
FIG. 10 is a perspective view of a fifth embodiment of a fragmenting projectile according to the present invention.
Figure 11:
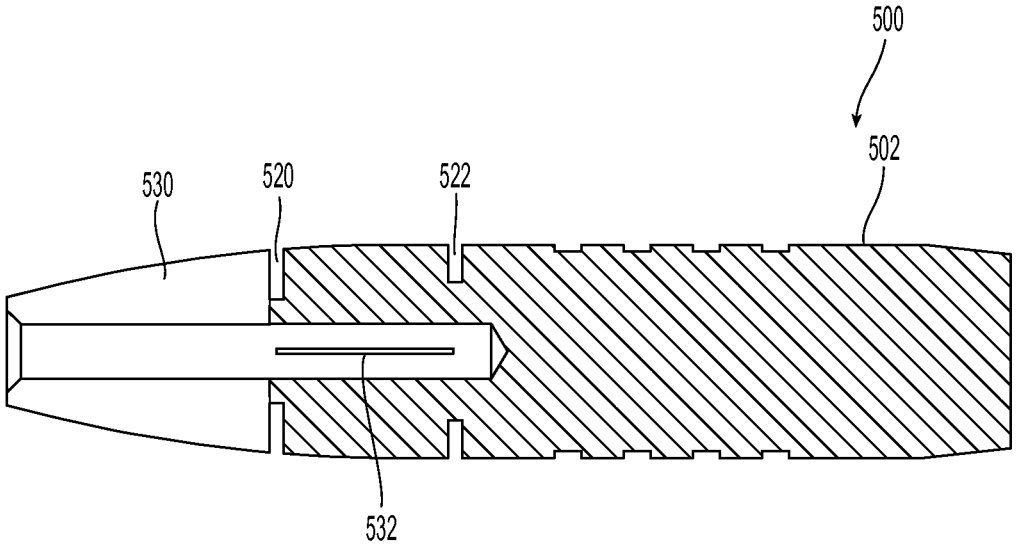
FIG. 11 is a cross section view of the fragmenting projectile in FIG. 10 along the line 11-11.

Another fragmenting projectile 500 is illustrated in FIGS. 10 and 11. The main body 502 of the fragmenting projectile 500 may be the same as those described above. However, in this embodiment, the first and second plurality of slots 530,532 extend along the length of the main body 502 differently. Looking at FIG. 11, the first plurality of slots 530 extend only between the front end 504 and the first circumferential groove 520. The second plurality of slots 532 extend only between the first and the second circumferential grooves 520,522. In this embodiment, the slots do not cross over the circumferential grooves. It should be noted that while two grooves are illustrated for each of the first and second plurality of slots 530,532, there may more slots in either or each of the plurality of slots and still fall within the scope of the present invention.

Figure 12:
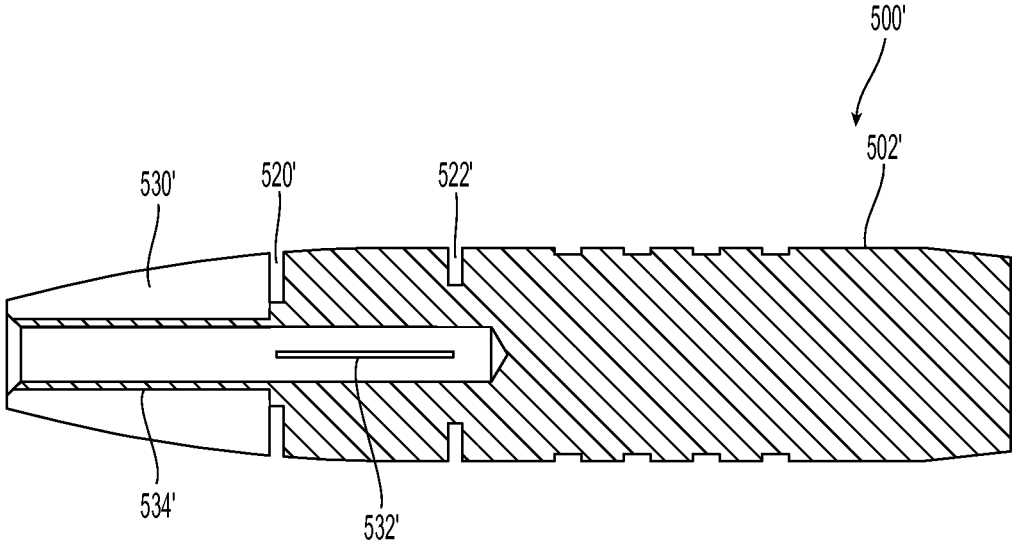
FIG. 12 is a cross section view of another embodiment of a fragmenting projectile showing a slot with a flat bottom surface.

Another fragmenting projectile 500' is illustrated in FIG. 12. The main body 502' of the fragmenting projectile 500' is the same as in FIGS. 10 and 11, with a the plurality of slots 530',532' and first and the second circumferential grooves 520',522'. However, the bottom surface 534' of the plurality of slots 530',532' is flat along at least a portion thereof. The bottom of the other embodiments may also be flat along at least a portion thereof, even if they are slanted relative to the longitudinal axis of the projectiles.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

We claim:

1. A fragmenting projectile comprising:

a main body having a front end, a back end, and a middle portion therebetween, the main body having a longitudinal axis extending therealong;

an opening extending from the front end toward the middle portion, the opening having a bottom;

at least two circumferential grooves extending around the main body, a first circumferential groove disposed between the front end and a second circumferential groove, the second circumferential groove being disposed between the first circumferential groove and the bottom of the opening;

a first plurality of slots disposed around the main body and extending from the front end rearwardly to a position between the first circumferential groove and the second circumferential groove; and a second plurality of slots disposed around the main body, the second plurality extending between the first and second circumferential groves.

2. The fragmenting projectile according to claim 1, wherein one of the first plurality of slots is at least partially disposed between two of the second plurality of slots.

3. The fragmenting projectile according to claim 1, wherein the opening has a central axis, the central axis of the opening is coaxial with the longitudinal axis.

4. The fragmenting projectile according to claim 1, wherein the first and second plurality of slots have a constant depth.

5. The fragmenting projectile according to claim 1, wherein the first and second plurality of slots have a variable depth.

6. The fragmenting projectile according to claim 1, wherein the first and second plurality of slots have a bottom surface, the bottom surface being curved along at least a portion of a length thereof.

7. The fragmenting projectile according to claim 1, where the first and second plurality of slots have a bottom surface, the bottom surface being flat along at least a portion of a length thereof.

8. The fragmenting projectile according to claim 1, wherein the first and second plurality of slots extend at least partially around the main body.

9. A fragmenting projectile comprising:

a main body having a front end, a back end, and a middle portion therebetween, the main body having a longitudinal axis extending therealong;

an opening extending from the front end toward the middle portion, the opening having a bottom; and a first means for fragmenting at least a portion of the projectile in a first stage after engaging an object; and a second means for fragmenting at least a portion of the projectile in a second stage after engaging the object, the second stage coming after the first stage.

10. The fragmenting projectile according to claim 9, wherein the first means comprises a first circumferential groove and a first plurality of slots extending from the front end of the main body to the first circumferential groove and the second means comprises a second circumferential groove disposed between the first circumferential groove and the back end and a second plurality of slots extending from the first circumferential groove to the second circumferential groove.

11. The fragmenting projectile according to claim 10, wherein each of the first plurality of slots is circumferentially disposed between two of the second plurality of slots.

12. A fragmenting projectile comprising:

a main body having a front end, a back end, and a middle portion therebetween, the main body having a longitudinal axis extending therealong;

an opening extending from the front end toward the middle portion, the opening having a bottom;

at least two circumferential grooves extending around the main body separated from one another, a first circumferential groove disposed between the front end and a second circumferential groove, the second circumferential groove being disposed between the first circumferential groove and the bottom of the opening, the first and second circumferential grooves being separated from one another by a portion of the main body;

a first plurality of slots disposed around the main body and extending from the front end rearwardly towards the back end and the first circumferential groove; and a second plurality of slots disposed around the main body, the second plurality extending between the first and second circumferential groves.

13. The fragmenting projectile according to claim 12, wherein one of the first plurality of slots is at least partially disposed between two of the second plurality of slots.

14. The fragmenting projectile according to claim 12, wherein the opening has a central axis, the central axis of the opening is coaxial with the longitudinal axis.

15. The fragmenting projectile according to claim 12, wherein the first and second plurality of slots have a constant depth.

16. The fragmenting projectile according to claim 12, wherein the first and second plurality of slots have a variable depth.

17. The fragmenting projectile according to claim 12, wherein the first and second plurality of slots have a bottom surface, the bottom surface being curved along at least a portion of a length thereof.

18. The fragmenting projectile according to claim 12, where the first and second plurality of slots have a bottom surface, the bottom surface being flat along at least a portion of a length thereof.

19. The fragmenting projectile according to claim 12, wherein the first and second plurality of slots extend at least partially around the main body.

* * * * *